United States Patent [19]

von Madeyski et al.

[11] Patent Number: 4,723,491

[45] Date of Patent: Feb. 9, 1988

[54] SECONDARY SUSPENSION FOR A RAIL VEHICLE TRUCK

[75] Inventors: Thilo von Madeyski, Hanover; Hans Gebhard, Minden/Westf.; Wilfried Schwier, Petershagen, all of Fed. Rep. of Germany

[73] Assignee: Waggon Union GmbH, Fed. Rep. of Germany

[21] Appl. No.: 942,504

[22] Filed: Dec. 16, 1986

[30] Foreign Application Priority Data

Dec. 20, 1985 [DE] Fed. Rep. of Germany ..... 8535955

[51] Int. Cl.[4] ..... B61F 5/00

[52] U.S. Cl. ..... 105/198.7; 29/402.08; 29/426.6; 267/4

[58] Field of Search ..... 105/198.7, 197.05, 182.1; 29/402.08, 426.6, 446; 267/4, 6

[56] References Cited

U.S. PATENT DOCUMENTS 1,757,937 5/1930 McCullough ..... 105/197.05

1,964,184 6/1934 Shafer ..... 105/197.05

2,424,625 7/1947 Nystrom et al. ..... 105/198.7

2,703,924 3/1955 Huard ..... 29/402.08 X

*Primary Examiner*—Sherman D. Basinger

*Attorney, Agent, or Firm*—McGlew and Tuttle

[57] ABSTRACT

A secondary suspension for a rail vehicle truck is arranged between a suspension support connected to the car body of the vehicle and a spring support. It comprises several spring groups, whose spring elements each have a set of coil springs held by an upper and a lower spring plate and a metal-rubber spring element and are individually interchangeable. The spring elements are designed so that replacement of the spring groups can be carried out with the truck installed on the vehicle and without using a pressure stand or a lift. This goal is achieved by the fact that there are at least two diametrically opposed holder claws for spring tension holders on the upper and the lower spring plate of the spring groups, to which the spring tension holders are attached when the spring elements are compressed.

5 Claims, 11 Drawing Figures

SECONDARY SUSPENSION FOR A RAIL VEHICLE TRUCK

FIELD AND BACKGROUND OF THE INVENTION

The present invention relates in general to rail vehicles, and in particular to a new and useful secondary suspension for a rail vehicle truck, which is arranged between a suspension support connected to the vehicle car body and a spring support and which contains several spring groups, whose elements each consist of a set of coil springs held by an upper and a lower spring plate and a metal-rubber spring element and are individually interchangeable.

In known rail vehicle trucks with coil springs in the secondary suspension stage, the removal of spring sets, the placement of inserts under these spring sets or the replacement of broken individual springs is only possible in the repair shop. This is because the car body has to be put on a lift, together with the secondary suspension, in order to do this work. If the secondary suspension is in a crooked position, because a spring has broken, removal of the springs is actually only possible in the compressed or pressurized state. Since such damage generally occurs only during operation, that is, between overhauls, the vehicles must be specifically brought to a repair shop to repair this damage, and this causes a significant down time of the vehicles.

SUMMARY OF THE INVENTION

In accordance with the invention, these disadvantages are to be eliminated by a new design for the individual components, so that repair of the secondary suspension is also possible in every operating plant, even without a lift or pressure stand.

Accordingly, an object of the present invention is to provide a secondary suspension arrangement for a rail vehicle truck having a body car which is arranged between a suspension support that is connected to the body car and a spring support, comprising a plurality of spring groups. Each spring group comprises a set of coil springs having upper and lower spring plates at its opposite ends for holding the coil springs, and a metal-rubber spring element below the lower spring plate. The upper and lower spring plates each have outer rims with diametrically opposed claws that can be engaged on opposite sides of the plates by spring tension holders. The entire rotation means are also engaged between the upper spring plate and the suspension support, and between the lower spring plate and the metal-rubber spring element to prevent relative rotation between these parts. The metal-rubber spring element is also provided with anti-rotation means for preventing relative rotation between it and the spring support. The spring support has a bore for receiving the die of a pressure or lifting device which can pass through the bore and engage a holding bore of the lower spring plate. This facilitates compression of the coil springs to permit engagement of spring tension holders onto the claws of the upper and lower plates. The spring tension holders each have a pair of spaced apart eyes for engaging the claws of the spring plates.

In this manner, individual spring sets can be removed or installed, or inserts can be placed under them, without lifting off the car body and without removing the suspension support, with the car body in place, using a mobile or a fixed pressure stand or lift in combination with spring tension holders.

Accordingly, a further object of the present invention is to provide a secondary suspension arrangement for a rail vehicle truck which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

The embodiment of the invention is described using the drawing, wherein.

DESCRIPTION OF THE PREFERRED EMBODIMENTS

Figure 1:
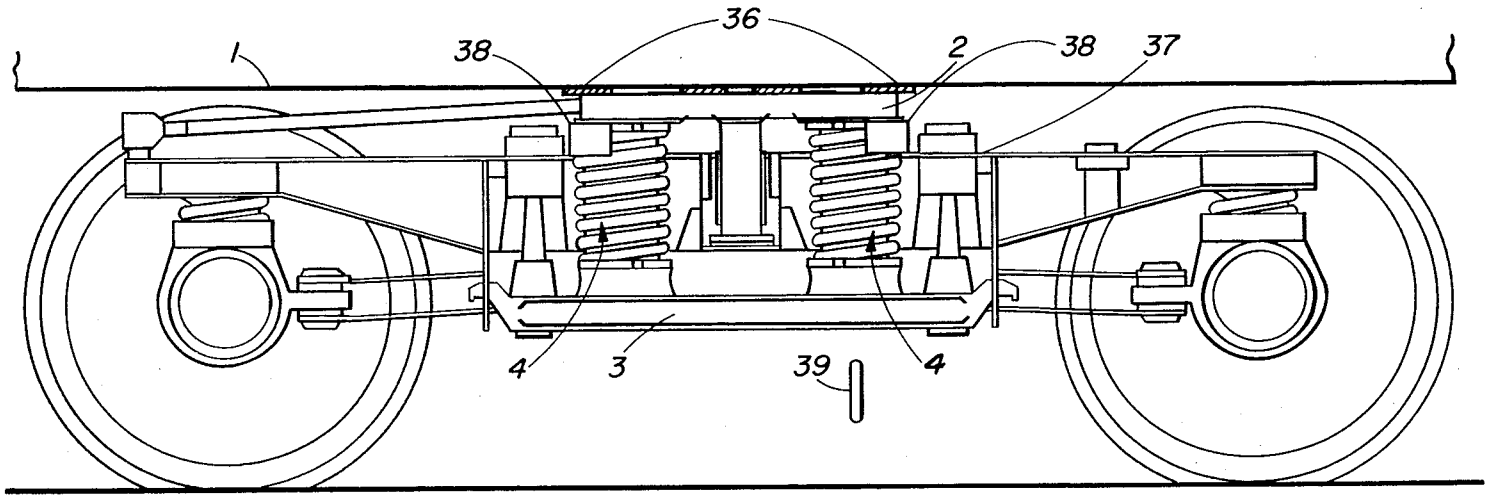
FIG. 1 is a side elevational view of a truck with the secondary suspension according to the invention and a car body in place.

Referring to the drawings in particular, the invention embodied in FIG. 1 comprises a secondary suspension for a rail vehicle truck which has spring groups that can be easily replaced.

Figure 2:
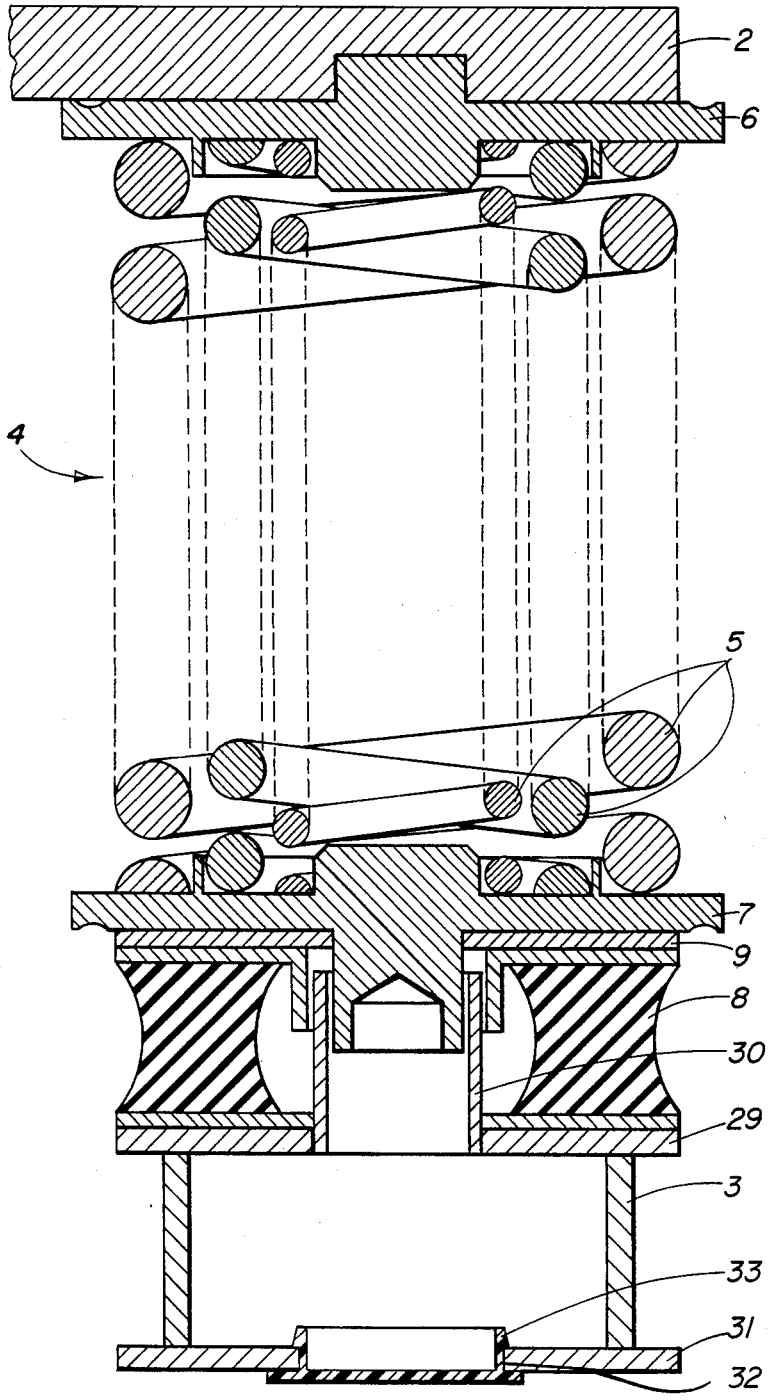
FIG. 2 is an axial sectional view of a spring group.

On a rail vehicle, the secondary suspension is arranged between a suspension support 2 connected to the car body 1 and a spring support 3. It comprises several spring groups generally designated 4 (FIG. 2), which each comprises a set of coil springs 5 held between an upper spring plate 6 and a lower spring plate 7, and a metal-rubber spring element 8 (Megi spring). An insert 9 can also be placed between the lower spring plate 7 and the Megi spring 8.

Figure 3B:
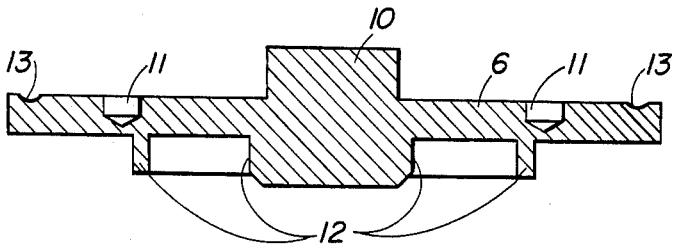
FIG. 3*b* is an axial sectional view of the upper spring plate.
Figure 3A:
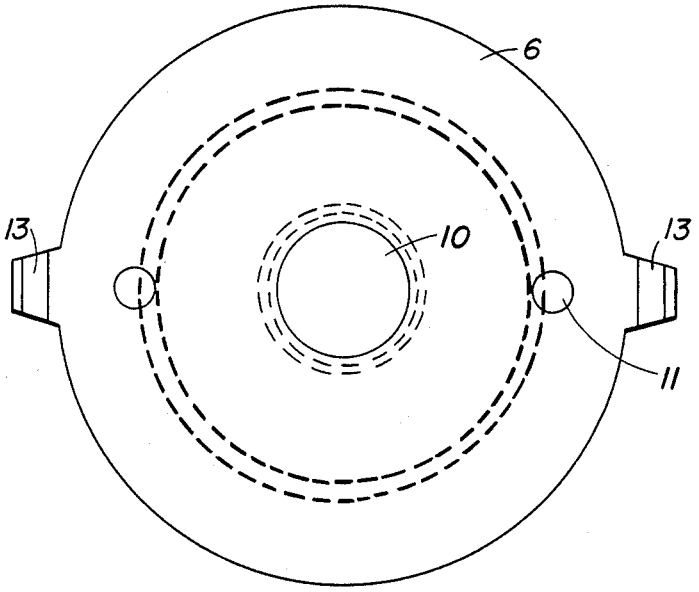
FIG. 3*a* is a top plan view of an upper spring plate.

The upper spring plate 6 (FIGS. 3*a* and 3*b*) has a center cog 10 on its top side, which is a guide and rests in the suspension support 2, and bores 11 to hold cogs of the suspension support 2, to prevent rotation. This forms first anti-rotation means. On its bottom side, there are spring guides 12 to secure the position of the coil springs 5. On its outer rim, the upper spring plate 6 has two claws 13 to hold spring tension holders 14.

Figure 4B:
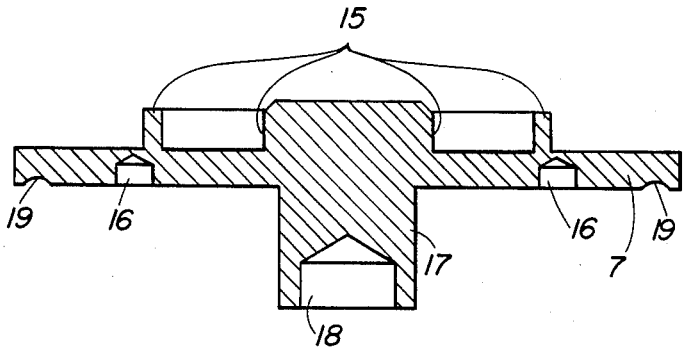
FIG. 4*b* is an axial sectional view of the lower spring plate.
Figure 4A:
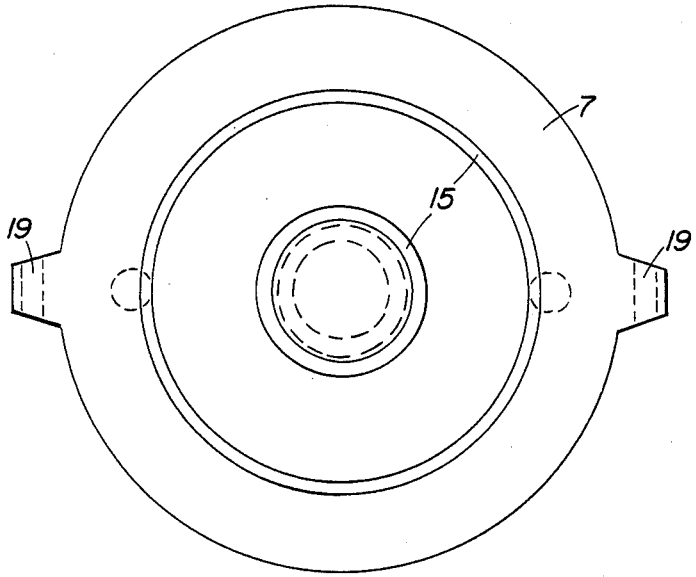
FIG. 4*a* is a top plan view of a lower spring plate.

The lower spring plate 7 (FIGS. 4*a* and 4*b*) has spring guides 15 on its top side which are similar to those of the upper spring plate 6. On its bottom side, there are bores 16 as elements to prevent rotation relative to the metal-rubber spring element 8 as well as a center cog 17 with a holder bore 18. This forms second anti-rotation means. On its outer rim, the lower spring plate has two claws 19 to hold the spring tension holders 14, just like the upper spring plate.

Figure 5B:
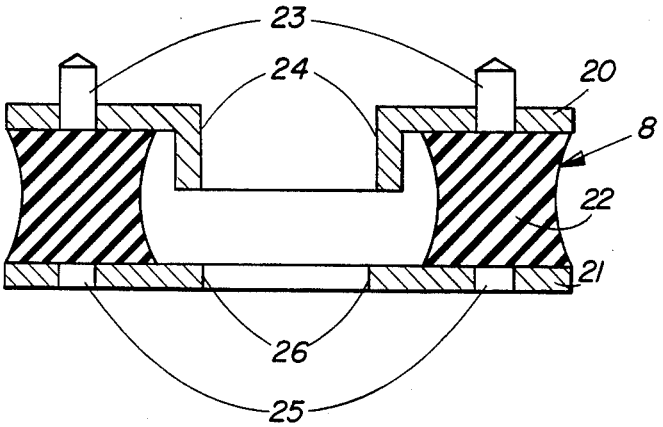
FIG. 5*b* is an axial sectional view of the spring element.
Figure 5A:
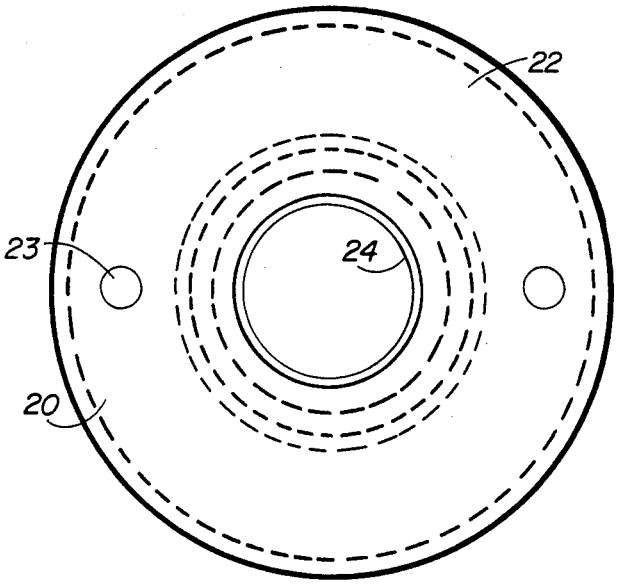
FIG. 5*a* is a top plan view of a metal-rubber spring element.

The metal-rubber spring element 8 FIGS. 5*a* and 5*b* consists of a cover plate 20, a base plate 21 and a ring-shaped elastomer part 22 which is located between them. The cover plate 20 has cogs 23 on its top side, which act together with the bores 16 of the lower spring plate 7 to prevent rotation, and a guide sleeve 24, which proceeds from a center bore, on its bottom side. In the base plate 11, bores 25 to hold cogs of the spring support 3 are provided to prevent rotation, as well as a center guide bore 26. Cogs 23 and bores 25 form third anti-rotation means.

Figure 6:
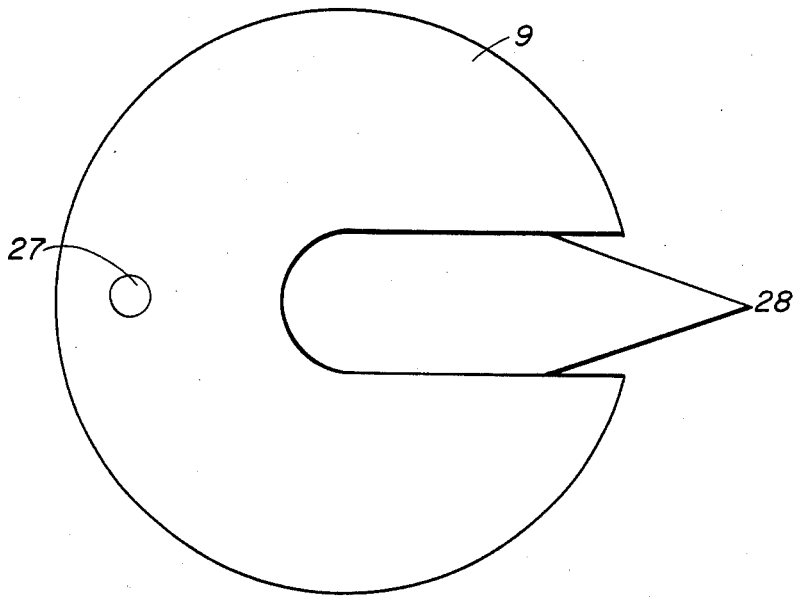
FIG. 6 is a top plan view of an insert.

The insert 9 (FIG. 6) can be used in various thicknesses, in order to balance out settling of the spring groups 4. It has at least one bore 27 to hold a cog of the cover plate 20 or of the spring support 3 (if insert 19 is to be positioned between plate 22 and support 3) to prevent rotation and a slot 28 which reaches from the center to the outer rim. This slot 28 has a width which corresponds to the diameter of the center cog 17 of the lower spring plate 7 and thereby allows insertion or replacement of the insert 9 without disassembly of the spring group 4.

The spring support 3 (FIG. 2) has a center bore in its upper belt 29, from which a guide bushing 30 extends in an upward direction, with this guide bushing holding the center cog 17 of the lower spring plate 7 on the inside and the guide sleeve 24 of the cover plate 20 of the metal-rubber spring element 8 on the outside. In a lower belt 31 of the spring support 3, there is an opening 32, whose diameter is equal to at least the inner diameter of the guide bushing 30 and which can be closed off with a cap 33, in order to prevent the penetration of dirt, water and cleaning agents.

Figure 7A:
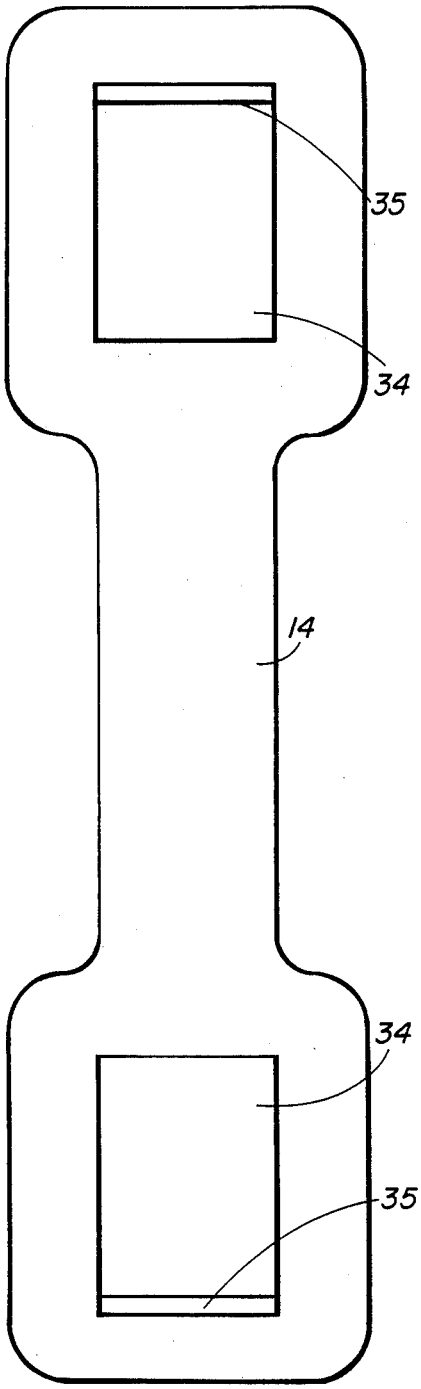
FIG. 7*a* is a side elevational view of a solid spring tension holder.
Figure 7B:
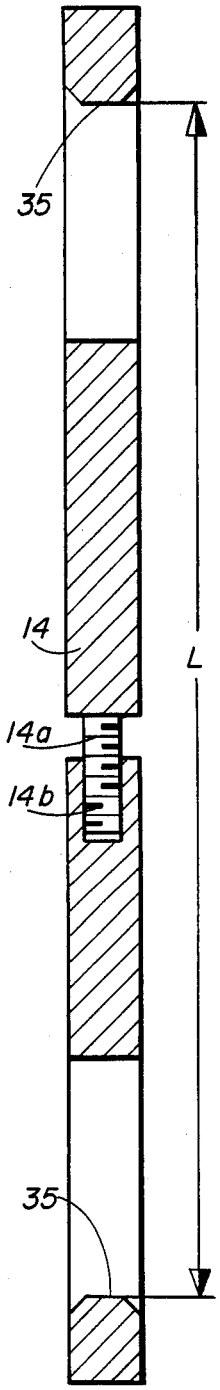
FIG. 7*b* is a sectional view of the holder of FIG. 7*a* except with adjustment means added.

The spring tension holders 14 (FIGS. 7*a* and 7*b*) have an eye 34 at each of their opposite ends, by means of which they are hung over the holder claws 13 and 19 of the upper and lower spring plates 6 and 7. The holding surfaces 35 are beveled at an angle, for adjustment and for secure assembly. The distance L between the two holder surfaces 35 of a spring tension holder 14 is dependent on the height of the set of coil springs 5. The distance L can be made adjustable by means of a thread 14*a* with sleeve 14*b* or something similar.

WORKING METHOD

Support blocks 36 (FIG. 1) are inserted between the top of the secondary suspension 2 and the bottom of the car body 1, above all four spring groups 4. In the same way, support blocks 38 are inserted between the bottom of the secondary suspension 2 and the top of the longitudinal support 37 (viewed from the outside) behind all four spring groups 4.

This fixes the secondary suspension 2 in its initial position. In order to prevent moving of the car body or the suspension during the subsequent pressure and lifting, if the springs are hard, using a catch device (for example, claws, hooks, or something similar) which is attached to the rail element, for example. The set of coil springs 5 is now compressed practically to block length using a pressure or lifting device 39, which is only indicated schematically in the diagram. For this purpose, a die of the pressure or lifting device 39 (not shown) is placed into the center cog 17 of the lower spring plate 7, through the opening 32, after removal of the cap 33, and pressure is placed on it. After the springs are compressed, the spring tension holders 14 are hung over the holder claws 13 and 19 of the upper and lower spring plates 6 and 7 by their eyes 34. After the die of the pressure or lifting device 39 has been moved out again, the spring group 4, that is the compressed set of coil springs 5, the metal-rubber spring element 8 and, if applicable, the insert 9, can be taken out. In order to now insert or replace an insert 9, it is not necessary to move the die of the pressure or lifing device 39 out, since the insert 9 can be pushed over the center cog 17 of the lower spring plate 7 with its slot 28.

The installation of a new set of coil springs is carried out in the reverse sequence, after the springs have been compressed in a pressure device (for example, a spring testing machine) and the spring tension holders have been attached.

If the secondary suspension is crooked because a spring has broken on one side, the secondary suspension is first adjusted so that it is parallel to the car body, using the pressure or lifting device. Then the support blocks are inserted, and finally, the process described above is carried out.

While specific embodiments of the invention have been shown and described in detail to illustrate the application of the principles of the invention, it will be understood that the invention may be embodied otherwise without departing from such principles.

What is claimed is:

1. A secondary suspension arrangement for a rail vehicle truck having a car body and which is arranged between a suspension support connected to the car body and a spring support, comprising a plurality of spring groups, each group comprising a set of coil springs, an upper and a lower spring plate respectively engaged with opposite ends of said set to hold said set, and a metal-rubber spring element, said set of coil springs with said upper and lower spring plates and said spring element being individually interchangeable, said upper spring plate (6) having first anti-rotation means (11) for preventing rotation relative to the suspension support (2) and an outer rim with a pair of diametrically opposed holder claws (13) adapted for spring tension holders (14), said lower spring plate (7) having second anti-rotation means (16) for preventing rotation relative to said metal-rubber spring element (8), an outer rim with a pair of diametrically opposed holder claws (19) adapted for spring tension holders (14) and a holder bore (18) adapted for receiving the die of a pressure device (39), said metal-rubber spring element (8) having anti-rotation means (23,25) for preventing rotation relative to the spring support (3) and said lower spring plate (7), the spring support (3) adapted for receiving the die of a pressure device (39) to pass therethrough and into engagement with said holder bore, and a pair of spring holders (14) each having two eyes (34) for engaging said holder claws (13), (19) of said spring plates (6,7).

2. A secondary suspension arrangement according to claim 1, wherein said anti-rotation means for preventing rotation comprises cogs and bores.

3. A secondary suspension arrangement according to claim 1, wherein the distance (L) between said eyes (34) of said spring tension holders (14) is adjustable.

4. A secondary suspension arrangement according to claim 1, including an insert (9) engaged between said lower spring plate and said metal-rubber spring element, said insert being engaged by said second and third anti-rotation means for preventing relative rotation between said insert, said lower spring plate and said metal-rubber spring element.

5. A secondary suspension arrangement according to claim 4, wherein said insert comprises a disc having a slot extending from an outer rim thereof to a center thereof, said lower spring plate having a downwardly extending center cog (17) which carries said holder bore (18), said slot of said insert being engaged around said center cog, said anti-rotation means all comprising cogs which are engaged into bores, said metal-rubber spring element carrying two of said cogs which extend into two of said bores carried by said lower spring plate, one of said cogs extending through said slot of said insert, said insert including a bore for receiving the other of said cogs.

* * * * *